US005881711A

United States Patent [19]

Ban et al.

[11] Patent Number: 5,881,711

[45] Date of Patent: Mar. 16, 1999

[54] VISCOUS HEATER

[75] Inventors: Takashi Ban; Shigeru Suzuki; Tatsuyuki Hoshino; Hidefumi Mori; Takahiro Moroi, all of Kariya, Japan

[73] Assignee: Kabushiki Kaisha Toyoda Jiboshokki Seisakusho, Kariya, Japan

[21] Appl. No.: 888,466

[22] Filed: Jul. 7, 1997

[30] Foreign Application Priority Data

Jul. 19, 1996 [JP] Japan ..... 8-190922
Nov. 25, 1996 [JP] Japan ..... 8-313504

[51] Int. Cl.[6] ..... F24C 9/00

[52] U.S. Cl. ..... 126/247; 122/26

[58] Field of Search ..... 126/247; 122/26; 165/80.4

[56] References Cited

U.S. PATENT DOCUMENTS 1,366,455 1/1921 Henson ..... 126/247
3,075,514 1/1963 Paugh ..... 126/247
3,198,191 8/1965 Wyszomirski .
5,034,688 7/1991 Moulene et al. ..... 165/80.4
5,573,184 11/1996 Martin .

FOREIGN PATENT DOCUMENTS 0687584 12/1995 European Pat. Off. .
2494782 5/1982 France .
19635338 6/1997 Germany .
2246823 10/1990 Japan .

*Primary Examiner*—Carl D. Price
*Attorney, Agent, or Firm*—Burgess, Ryan & Wayne

[57] ABSTRACT

A viscous heater is provided with a front side plate 2 and a rear side plate 3, which are arranged so that a heat generating chamber 5 is formed between their facing back surfaces and which are stored in a housing so that heat emission chambers FW and RW are formed between the side plates and the housing. The housing is formed by a front housing having a tubular part 1*c* which extends axially for storing the front and side plates radially inwardly of the tubular part 1*c* and a rear housing 4. Thus, sealing is necessary only at a location where the front and rear housings 1 and 4 are connected with each other. Thus, a very simple structure is sufficient for preventing any leakage of the recirculated fluid.

17 Claims, 3 Drawing Sheets

VISCOUS HEATER

BACKGROUND OF THE INVENTION

1. Field of the Invention

The present invention relates to a viscous heater, wherein a viscous fluid is subjected to a shearing force to generate a heat which is used as a heat source which is subjected to a heat exchange with a heating medium recirculated to a heating system.

2. Description of Related Art

A Japanese Unexamined Patent Publication No. 2-246823 discloses a viscous heater used for a heating system for a vehicle. The viscous heater includes a front and a rear housing, which face each other and are connected by means of bolts, while a heat generating chamber and a water jacket are formed between the housings, so that the water jacket is located outside the heat generating chamber. Provided in the water jacket is an inlet for taking in the recirculated water into the water jacket and an outlet for discharging the recirculated water after subjected to a heat exchange into the heating system. A drive shaft is rotatably supported to a housing by means of a bearing unit. Connected to the drive shaft is a rotor, which is arranged in the heat generating chamber, so that the rotor is rotated in the heat generating chamber. Furthermore, a gap is formed between the inner surface of the heat generating chamber and the outer surface of the rotor, and a viscous fluid, such as a silicone oil, is filled in the gap.

However, in the viscous heater in the prior art, the heat generating chamber as well as the water jacket as the heat emission chamber are formed only by the front and rear housings as one piece members respectively. As a result, the front and rear housings have complicated shapes, which increases the production cost of these parts.

Furthermore, in the viscous heater in the prior art, the inner wall of the heat emission chamber has a relatively small surface area, resulting in a reduced value of the heat exchanging efficiency. Furthermore, a measure is not provided as far as problems such as a leakage of the viscous fluid and a thermal degradation of parts made from a non-metallic material are concerned.

In view of the above, in order to improve productivity, separate members can be used for forming a heat emission chamber in such a manner that, between the members, the front and rear housings for constructing the heat emission chamber are simply connected. However, this structure is disadvantageous in that the number of contacting surfaces, which necessitate water seal members, is increased. Furthermore, an increased precision is required in order to obtain a desired anti-water leakage property.

SUMMARY OF THE INVENTION

An object of the present invention is to provide a viscous heater capable of producing at high productivity, while being easy to maintain.

Another object of the present invention is to provide a viscous heater capable of an increased heat exchange efficiency.

Another object of the present invention is to provide a viscous heater capable of preventing leakage of the viscous fluid and of the recirculating fluid.

In the invention, a viscous heater is provided, comprising:

a front and rear side plates which are axially contacted, so that a heat generating chamber is formed between the plates;

a front and rear housings between which said front and rear side plates are arranged, so that heat emission chambers for a recirculation of a fluid are formed between the housings and the side plates, respectively;

an inlet port and outlet port for introduction of the recirculated fluid into the heat emission chamber and for removing the fluid from the heat emission chamber, respectively;

a drive shaft for receiving a rotating movement from an outside rotating movement source;

a bearing means for rotatably supporting the drive shaft to at least one of the front side plate and front housing, and;

a rotor integrally connected to the drive shaft and located in the heat generating chamber so that a heat generating gap is formed between an inner surface of the heat generating chamber and an outer surface of the rotor;

a viscous fluid being filled in said heat generating gap, so that the rotating movement of the rotor causes heat to be generated in the viscous fluid;

at least one of the housings being formed with an axially extending tubular portion, which sealingly encircles said front and rear side plates.

In this structure of the viscous heater, the front and rear side plates, in which the generating chamber is formed and of which the emission chambers are formed at the face back surfaces, are encircled by the tubular portion of the housing, so that an outwardly sealing is necessary only at the location where the housings are connected. Thus, without complicating the structure, the recirculated fluid is positively prevented from being leaked. The tubular portion may preferably be formed as a circular tubular shape.

The tubular portion may be extended from said front housing defining an opened end surface, while said rear housing is formed as a plate shape which is connected to the open end of the tubular portion of the front housing. This structure allows the opened end of the tubular portion of the front housing to be conveniently covered by the rear housing as a plate shape, thereby allowing the structure to be further simplified.

A sealing means may be arranged between the faced end surfaces of the front and rear housings. The employment of the sealing means, such as an O-ring allows the sealing to be obtained by the simplified structure.

Each of the side plates may form axially extending fins at the surface forming the heat emission chamber. The provision of the fins allows the effective surface area to be increased, thereby increasing a heat exchanging efficiency with respect to the recirculated heating fluid.

Said fins may be formed as radially spaced and concentric arc shaped portions extending between said inlet port and the outlet port for forming radially spaced arc shaped passageways for the recirculated fluid from the inlet port to the outlet port. Advantageously, the passageway at the radially outer location has an increased width over the one located at the radially inner location. In this structure, due to an increased width of the flow passageway at the outer peripheral location, which is effective for equalize the speed of the flow of the recirculating fluid, resulting in an effective heat exchange at the outer peripheral part, where an increased heat emission is occurred.

A space can exist between an end of the fins and an inner surface of the housing forming the heat emission chamber. Due to the provision of the space between ends of the fins and inner surfaces of the housings, the heat as contained in the side plates is prevented from being directly transmitted to the housings and then to the outside atmosphere. Thus, a further increase in the heat exchange efficiency is obtained.

At least the surface of each of the side plates constructing the heat emission chamber can be formed as a molded surface. This is effective for eliminating an unnecessary machining process, thereby enhancing productivity. Furthermore, a further increase in the surface area is obtained, resulting in an increase in heat exchange performance. Also at surfaces of walls of both of the housings constructing the heat emission chamber, it is desirable that the surfaces are formed as molded ones except at necessary areas.

A provision may be made of means arranged between the front and the rear side plates and the front and rear housing for stopping the side plates from being subjected to a self rotating movement. The self rotation blocking means may be constructed by a conventional means such as a pin or a key. However, said self rotation blocking means may comprise a first engaging part and a second engaging part in the faced surfaces of the side plate and the housing, said first and second engaging parts being engaged with each other in a direction of a rotation. Thus, a simpler structure is sufficient for positively preventing the self rotation of the side plate.

The side plate can be, at its central part, formed with an axially extending fitting part, which is fitted to a faced fitting part in the housing, and a seal member is arranged between fitting parts of the side plate and the housing, thereby obtaining a sealed structure of the heat emission chamber, while allowing the fitting parts to be slidably moved with each other. In the situation that a relative movement is occurred between the side plate and the housing due to a thermal deformation, the central fitting parts as well as the sealing member between the fitting parts allows the thermal deformation to be absorbed and prevents the recirculated fluid from leaking inwardly.

The side plate and housing may be, at their faced surfaces, formed with axially abutting parts, and a seal member is arranged between the faced surfaces of the abutting parts to obtain a sealed structure between the heat emission chamber and the heat generating chamber. By this construction, a similar effect for preventing the leakage of the recirculated fluid is obtained.

An O-ring can be conveniently used as the sealing member.

The fitting parts or the axially abutting parts may form inwardly recessed portions which form a storage chamber for regenerating the viscous fluid in the heat generating chamber. In this structure, due to a provision of the storage chamber, a strict administration of the storage amount of the viscous fluid is unnecessary. Furthermore, due to a so-called Weissenberg effect, the viscous fluid in the heat generating chamber is recovered to the storage chamber, and the viscous fluid in the storage chamber is, under the effect of the stretching viscosity, fed to the heat generating chamber, thereby promoting the regenerating action. Thus, the thermal durability of the viscous fluid can be highly increased.

A provision may be made as to a shaft seal unit arranged between said bearing means and the heat generating chamber for obtaining a sealing of the drive shaft, the heat emission chamber extending to a location adjacent the shaft seal unit. This structure prevents the viscous fluid from leaking. Furthermore, the front heat emission chamber is extended to a location adjacent the shaft seal device, so that an indirect cooling of a non-metallic part such as a rubber constructing parts of the shaft seal unit is obtained, thereby protecting these parts from an influence of the heat.

In an embodiment, said bearing means is arranged in said front side plate, said bearing means comprising a sealing means for sealing the drive shaft, said heat emission chamber extending to a location adjacent to the said bearing means. This construction, in addition to the above advantage as to the provision of the sealing member, a following advantage is obtained. Namely, in the above structure, where the sealing member is separate from the bearing means, a number of workings during an assembly process is increased and an increased precision is required in order to keep an alignment at axially spaced two locations, i.e., the sealing member and the bearing means, resulting in, on one hand, an complicated production process and an increase in a production cost, on the other hand. The provision of the bearing means incorporated with the sealing means in the front side plate allows the number of the working process to be reduced, the number of locations requiring an increased precision to be reduced, and the number of parts to be reduced, resulting in a simplified production process as well as a reduction of a production cost.

BRIEF EXPLANATION OF ATTACHED DRAWINGS

DESCRIPTION OF PREFERRED EMBODIMENTS

Figure 1:
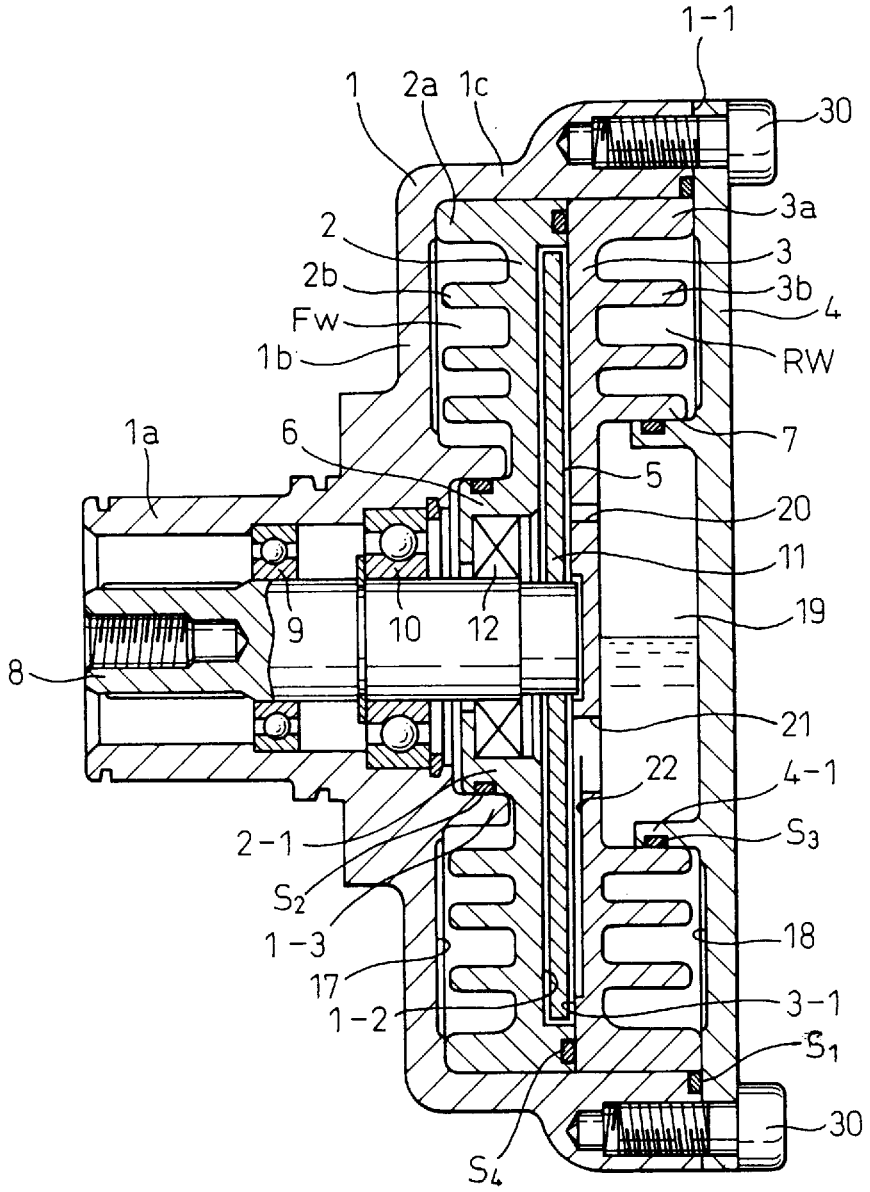
FIG. 1 is an axial cross sectional view of a viscous heater according to an embodiment of the present invention.
Figure 2:
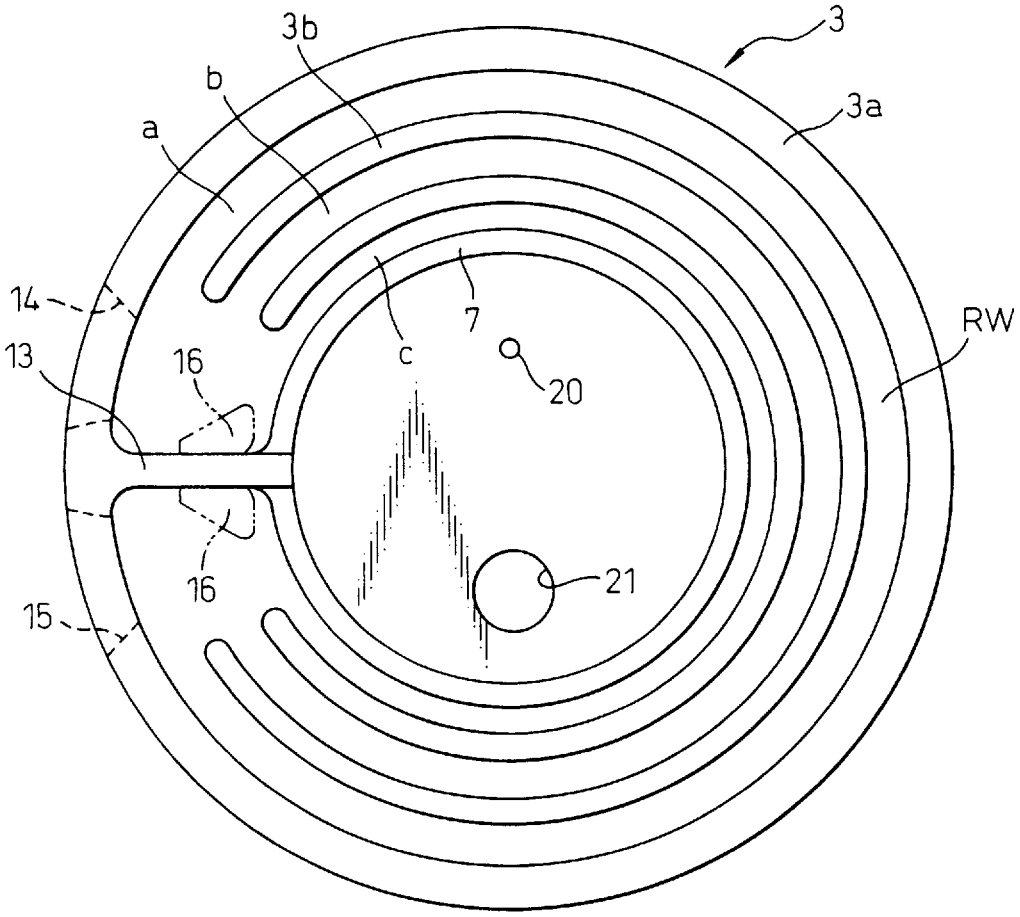
FIG. 2 is an elevational view of rear side plate of the viscous heater in FIG. 1.

In FIGS. 1 and 2 showing a first embodiment of the present invention, a reference numeral 1 denotes a front housing of a viscous heater. The front housing 1 includes a boss portion 1*a* projected forwardly having a front end, on which a transmission device, such as a clutch (not shown) is mounted, a radially extending disk portion 1*b* at a rear end of the boss portion 1*a* and a tubular portion 1*c* extending axially from the outer peripheral portion of the disk portion 1*b*. Arranged inside the tubular portion 1*c* are front and rear plates 2 and 3 in such a manner that these plates 2 and 3 are arranged in a back-to-back contacted relationship. The front housing 1 is formed with a rear annular end surface 1-1, with which a rear housing 4 of a substantially plate shape is contacted and is connected thereto by means of circumferentially spaced bolts 30. In other words, a space in the front housing 1 for storing the plates 2 and 3 is closed by the rear housing 4.

The plates 2 and 3 contained in the housings 1 and 4 have outer rim portions 2*a* and 3*a*, respectively, which are in a face-to-face contacted relationship and are fixedly held between the housings 1 and 4 by contact with the opposed inner surfaces thereof. The front plate 2 has, at its rear side facing the rear plate 3, a recess 1-2, which cooperates with the faced flat front end surface 3-1 of the rear plate 3, so that a heat generating chamber 5 is formed between the plates 2 and 3. The plate 2 forms, at its front end, a fitting portion 6 of a tubular shape, which is fitted to the front housing 1 at an annular portion 1-3. The plate 3 forms, at its rear end, a fitting portion 7 of a tubular shape, which is fitted to a rear housing 4 at an annular rib portion 4-1. As a result, between the front housing 1 and the front inner plate 2, an annular shaped water jacket FW as a front heat emission chamber FW is formed, while, between the rear housing 4 and the rear inner plate 3, an annular shaped water jacket as a rear heat emission chamber RW is formed. An O-ring $S_1$ is arranged between faced end surfaces of the housings 1 and 4. An O-ring $S_2$ is arranged between an inner cylindrical surface of the boss portion 1-3 of the housing 1 and an outer cylindrical surface of the fitting portion 6 of the inner front plate 2. An O-ring $S_3$ is arranged between an inner cylindrical surface of the fitting portion 7 of the inner rear plate 3 and an outer cylindrical surface of the rib portion 4-1 of the housing 4. Finally, an O-ring $S_4$ is arranged between faced end surfaces of the plates 2 and 3.

A drive shaft 8 is extended through the boss portion 1*a* of the front housing 1 and is supported by a pair of axially spaced bearing units 9 and 10. The drive shaft 8 has an inner end on which a rotor 11 is fixedly connected by any suitable means. The rotor 11 is arranged in the heat generating chamber 5 in such a manner that the rotor 11 rotates in the chamber 5 together with the rotating movement of the drive shaft 8. A shaft seal unit 12 such as an oil seal assembly is arranged between the boss portion 6 of the inner, front plate 2 and the shaft 3 at a location adjacent the front heat emission chamber FW. The axial seal unit 12 is for preventing a viscous fluid in the heat generating chamber 5 from outwardly leaking.

Due to the fitted structure between the fitting part 7 of the plate 3 and the inner rib 4-1 of the housing, a storage chamber 19 is formed between the plate 3 and the housing 4. The chamber 19 is for storing an excessive amount of the viscous fluid, which is fed to the heat generating chamber.

As shown in FIG. 1, the plates 2 and 3 are formed with radially spaced concentric fins 2*b* and 3*b*, respectively which axially extend in the opposite directions toward the heat emission chambers FW and RW, respectively. As shown in FIG. 2, the inner rear plate 3 is formed with a straight wall portion 13, which extends horizontally between the outer rib 3*a* and the inner rib (fitting part) 7 along the diametric axis of the plate 3. An inlet port 14 is formed in the plate 3 so that it is opened to the chamber RW on one side of the partition wall 13. An outlet port 15 is formed in the plate 3 so that it is opened to the chamber RW on the other side of the partition wall 13. The partition wall 13 and the fins 3*b* cooperate to divide the chamber RW into arc shaped sections a to c extending circumferentially between the inlet 14 and the outlet 15. As to the front, inner plate 2, a substantially similar structure is provided so that the chamber RW is divided into sections which are extended circumferentially from the inlet port to the outlet port. The inlet ports 14 are connected to an outside pipe for connection with a heating system (not shown) for introducing a heating medium from the pipe into the chamber RW and FW. The outlet ports 15 are connected to an outside pipe for connection with the heating system for recirculating the heating medium into the outside heating system. It should be noted that the arrangement of the width (effective flow area) of the section a to c is such that the width of the section is larger the further outward the section is positioned, i.e., a relationship a>b>c is obtained.

As shown in FIG. 2, the housing 1 and 4 is formed with a pair of spaced stopper part 16, between which the partition walls 13 are inserted, thereby preventing the front and rear plates 2 and 3 from being rotated with respect to the housings 1 and the 4, respectively. In other words, the partition walls 13 function also as a stopper of a rotating movement of the plates 2 and 3.

In the present invention, the side plates 2 and 3 are, at their entire inner surfaces constructing the heat emission chambers FW and RW, formed as a roughened surface such as ones obtained after casting, i.e., no machining is done after the casting of these parts 2 and 3. Similarly, the inner surfaces 17 and 18 of the front and rear housings 1 and 4 constructing the inner surfaces of the heat emission chambers FW and RW are also not machined, i.e., the surfaces 17 and 18 are roughened surfaces as obtained after casting.

As shown in FIG. 1, a gap (heat generating gap) is formed between an inner surface of the heat generating chamber 5 and an outer surface of the rotor 11, and a silicone oil as a viscous fluid is filled at the gap. The plate 3 is, at its upper part, formed with a recovery hole 20 and, at its lower part a feed hole 21. The recovery hole 20 is for recovery the silicone oil from the heat generating chamber 5 to the storage chamber 19. A feed hole 21 is provided in the plate 3 for feeding the silicone oil from the storage chamber 19 to the heat generating chamber 5.

Now, an operation of the viscous heater for a heating system of a vehicle according to present invention will be explained. A rotating movement from a crankshaft of an internal combustion engine of the vehicle is transmitted to the drive shaft 8 and to the rotor 11 in the heat generating chamber 5. The rotating movement of the rotor 11 in the heat generating chamber 5 causes the viscous fluid to be subjected to shearing at the gap between the inner surface of the heat generating chamber 5 and the outer surface of the rotor 11, thereby generating heat which is subjected to a heat exchange with the recirculated water in the front and rear water jackets FW and RW. The thus heated water is recirculated into the outside heating system and is used as a heat source for heating, for example, a cabin of the vehicle.

During the heating operation of the viscous heater according to present invention, the inner front and rear plates 2 and 3 constructing the front and rear heat emission chambers FW and RW are sealingly closed in the tubular portion 1*c* of the housing 1. As a result, among the seal portions, only the seal portion between the opened end of the tubular portion 1*c* of the housing 1 and the rear housing 4 is opened outwardly. As a result, leakage of the recirculating water is less likely. Furthermore, due to a simple plate shape of the rear housing 4, a simple shape of the O-ring $S_1$ is sufficient to obtain a desired sealing performance, resulting in an increase in a productivity.

Furthermore, in the structure of the viscous heater according to present invention, due to the facts that the inner surfaces of the side plates 2 and 3 forming the heat emission chambers FW and RW are formed with the fins 2*b* and 3*b* and that these surfaces are roughened ones, i.e., no machining is done after the casting, a highly increased effective contact area of the surfaces with the viscous fluid is obtained, resulting in an increased heat exchanging efficiency. The shown embodiment where the inner surfaces 17 and 18 of the housings 1 and 4, which construct the heat emission chambers FW and RW, are also roughened is more desirable. Finally, the fins 2*b* and 3*b* are spaced from the opposite surface of the housings 1 and 4, respectively, i.e., the fins 2*b* and 3*b* are prevented from being contacted with the housings 1 and 4, which otherwise causes the heat of the side plates 2 and 3 to be dissipated and lost by way of the housings 1 and 4.

Both of the side plates 2 and 3 are, at their central parts, formed with the fitting parts 6 and 7, respectively, which form inner peripheries of the heat emission chambers FW and RW. Furthermore, the fitting parts 6 and 7 are fitted to the front and rear side plates 2 and 3 via the O-rings $S_2$ and $S_3$, respectively. As a result, despite a relative axial movement between the housings 1 and 4 and the side plates 2 and 3 due to an effect of a thermal deformation, a desired sealed condition is maintained. In other words, any thermal deformation can be suitably absorbed.

Figure 3:
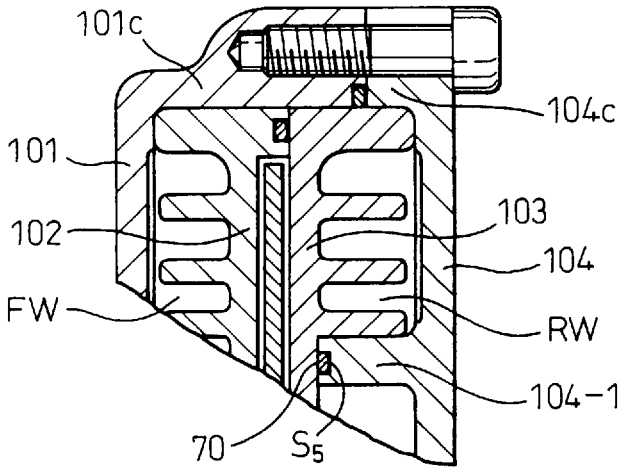
FIG. 3 is a partial view of a viscous heater in a second embodiment of the present invention.

As to the seal between the inner side plates and the housings, FIG. 3 shows a modification, where the fitting part 104-1 of the housing 104 extends axially until it axially abuts the faced surface of the plate 103. An O-ring $S_5$ is arranged between the axial end surface of the fitting part 104-1 and the rear surface of the plate 103. A similar structure is also taken as to the front housing 101 and the inner side plate 102. In the structure in the modification in FIG. 3, leakage of the recirculated water in the water jacket FW and RW does not occur.

In FIG. 1, in order to prevent the silicone oil in the heat generating chamber 5 from leaking, a shaft seal device 12 is arranged between the fitting part 6 of the side plate 2 and the drive shaft 8. The front heat emission chamber FW is extended to a location adjacent the shaft seal device 12, so that non-metallic members such as rubber members constructing the shaft seal unit 12 are cooled by the recirculated fluid although the cooling is done indirectly. Thus, thermal degradation of these parts does not occur.

A recirculated water as introduced into the water jacket via the outside inlet pipe (not shown) connected to the front housing 1 and the inlet port 14 is diverted into the branched passageways a, b and c, which are divided by the fins 2*b* and 3*b*, flows circumferentially in the a, b and c and issued from the outlet port 15 into the outside outlet pipe (not shown). In the present invention, the width of the branched passageways a, b and c divided by the fins 2*b* and 3*b* is such that the width of the outer passageway is larger than that of the inner passageway. As a result, a uniform heat exchange of the water is done with respect to all the wall surfaces of the side plates 2 and 3 constructing the front and rear heat emission chambers FW and RW. Namely, the outer passageway a has a largest value of the width, which causes a flow amount at the passageway a to be larger than that at the passageway b or c. Thus, an effective heat exchange is obtained at the passageway a, which corresponds to the outer peripheral location of the rotor 11, where a large heat is generated.

According to the present invention, the storage chamber 19 is provided so that it communicates with the central area of the heat generating chamber 5 via the recovery passageway 20. Furthermore, during a resting condition of the viscous heater, the silicone oil is located in the storage chamber 19 at its bottom portion due to the effect of own weight. As a result, a so-called Weissenberg effect as generated by the rotating movement of the shaft 8 causes, on one hand, the silicone oil in the heat generating chamber 5 to be recovered to the storage chamber 19 via the recovery passageway 20 and causes the silicone oil in the storage chamber 19 to be sucked into the heat generating chamber 5 via the feed hole 21 and the feed groove 22 due to the effect of the rotating movement of the shaft 8 and the viscosity of the silicone oil itself, on the other hand.

In short, in the viscous heater according to present invention, due to the provision of the storage chamber 19, a strict administration of a volume of the silicone oil as sealingly stored into the chamber 19 is not needed. Furthermore, a replacement, i.e., a recirculation of the silicone oil is always done between the heat generating chamber 5 and the storage chamber 19. Thus, shearing is evenly applied to all of the viscous fluid, which assists in prolonging the service life of the viscous fluid.

It should be noted that in the embodiment in FIG. 3, both of the front and rear housings 101 and 104 are formed with cup shaped portions 101*c* and 104*c*. However, the basic operation of the present invention is the same as that explained with reference to the first embodiment. Thus, a detailed explanation will be eliminated for the sake of the simplicity.

Figure 4:
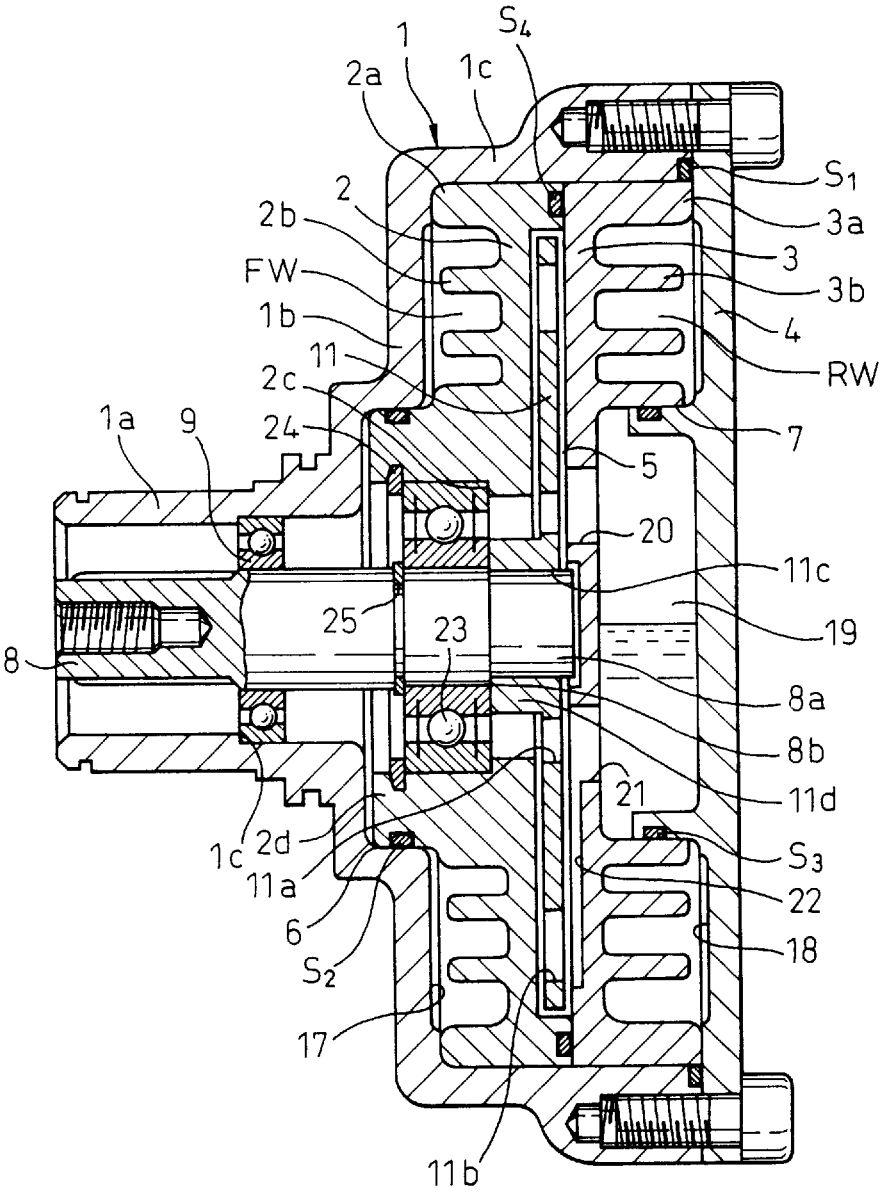
FIG. 4 is an axial cross sectional view of a viscous heater according to a further embodiment of the present invention.

FIG. 4 shows a third embodiment of the present invention. The embodiment is different from the first embodiment in FIG. 1 in that in place of the seal unit 12 in the front side plate 2 and the bearing unit 10 in the front housing 1 which are separate from each other, a bearing unit 23 incorporated with a sealing function is used.

In detail, the bearing unit 23 is constructed as a deep grooved ball bearing incorporated with a shaft sealing device and is arranged inside a boss portion 2*d* of the front side plate 2. The bearing unit 23 is held between an inner shoulder portion 2*c* and a circlip 24, while the bearing unit 23 is arranged adjacent to the heat generating chamber 5. As similar to the first embodiment in FIG. 1, a radial ball bearing unit 9 of a greece confined type is arranged inside the boss portion 1*a* of the front housing 1 so that the bearing unit 9 engages an inner shoulder portion 1*c*. These bearing units 9 and 23 are for rotatably supporting the drive shaft 8. It should be noted that the front heat emission chamber FW is extended to a location adjacent the bearing unit 23, so that non metallic parts, such as a rubber, of the bearing unit 23 is subjected to an indirect cooling by the recirculated water in the front heat emission chamber FW, thereby reducing a speed of degradation under the effect of a heat. The drive shaft 8 has at its rear end a reduced diameter portion 8*a*, which is press fitted to a press fit opening 11*c* of the rotor 11, so that the rotor 11 is rotated in the heat generating chamber 5 together with the rotating movement of the drive shaft 8. The rotor 11 is formed with a boss portion 11*d*, inside of which the opening 11*c* for the press fitting of the shaft 8 is formed. The boss portion 11*d* is in an axial abutment with an outer shoulder portion 8*b* at the end of the small diameter portion 8*a* of the drive shaft 8, so that a predetermined axial position of the rotor 11 on the shaft 8 is obtained. The shaft 8 is formed with an annular groove on which a circlip 25 is fitted, so that an inner lace of the bearing unit 23 is held between the boss portion 11*d* of the rotor 11 and the circlip 25, thereby obtaining a predetermined axial location of the bearing unit 23 on the shaft 8. The rotor 11 is, at its radially inner position, formed with a through hole 11*a*, which is, at its ends, opened to the heat generating chamber 5 and is, at its radially outer position, formed with a through hole 11*b*, which is, also, at its ends, opened to the heat generating chamber 5, thereby enhancing a shearing effect of the viscous fluid. The remaining construction of the embodiment in FIG. 4 is similar to that in the embodiment in FIG. 1 and therefore a detail explanation will be omitted. The viscous heater in the third embodiment has, in addition to the operational effects as explained with reference to the first embodiment, additional operational effects as explained hereinbelow. Namely, in the viscous heater in the third embodiment, the bearing unit incorporated with a shaft seal device is arranged in the front side plate 2. Thus, in comparison with the viscous heater in the first embodiment in FIG. 1 where the bearing 10 on the front housing 1 and the shaft seal unit 12 in the front side plate 2 are separated, the third embodiment can reduce a number of working steps during an assembly process, a number of locations in parts where an increased precision is required, and a number of parts, thereby simplifying the process for the assembly and reducing a production cost.

Furthermore, in the viscous heater in the third embodiment, the bearing unit 23 is arranged inside the boss portion 2*d* of the front side plate 2, and the bearing 9 is arranged in a boss portion 1*a* of the front housing 1. Thus, in comparison with the viscous heater in the first embodiment in FIG. 1 where boss of the bearings 9 and 10 are arranged in the boss portion 1*a* of the front housing 1, an increased span between the bearings 9 and 23 is obtained over that in the embodiment in FIG. 1. Due to such an increase in the span between the bearings, a reduction of a deflection of the shaft 8 is effectively reduced. In view of keeping the span as large as possible, it is desirable that the bearing unit 23 is located inside the boss portion 2*d* of the front side plate 2 at a location as rear as possible, i.e., at a location as near to the rotor 11 as possible.

We claim:

1. A viscous heater comprising:

front and rear side plates which are in axial contact, having vertical inner surfaces arranged so that a heat generating chamber is formed between the plates;

front and rear housings between which said front and rear side plates are arranged, to form heat emission chambers between the side plates and the housings for recirculation of a fluid, between the housings and the side plates respectively;

an inlet port and outlet port for introduction of the recirculated fluid into the heat emission chambers, and for removing the fluid from the heat emission chambers respectively;

a drive shaft arranged for rotation about a horizontal axis by an outside rotating movement source;

a bearing means for rotatably supporting the drive shaft by at least one of the front side plates and front housing;

a rotor integrally connected to the drive shaft and located in the heat generating chamber to form a heat generating gap between the inner vertical surface of said front and rear side plates in the heat generating chamber and an outer surface of the rotor; and a viscous fluid filled in said heat generating gap, so that the rotating movement of the rotor causes heat to be generated in the viscous fluid;

wherein at least one of the housings is formed with an axially extending tubular portion, which sealingly encircles said front and rear side plates; and wherein at least one of said front and rear side plates includes an axially extending fitting part at a radially inner location thereon, the fitting part being fitted to a facing fitting part provided on at least one of a corresponding front and rear housing, and at least one seal member is arranged between the fitting part of said at least one side plate and the fitting part of said at least one housing, to provide a sealed structure of at least one of said heat emission chambers, while allowing mutually fitted fitting parts to be axially slidably moved in relation to each other.

2. The viscous heater according to claim 1, wherein said tubular portion is extended from said front housing defining an opened end surface, while said rear housing comprises a plate shape which closes the open end surface of the tubular portion of the front housing.

3. The viscous heater according to claim 1, further comprising a sealing means arranged between facing end surfaces of the front and rear housings.

4. The viscous heater according to claim 1, wherein each of the side plates comprises axially extending fins at the surface forming the heat emission chamber.

5. The viscous heater according to claim 4, wherein said fins are formed as radially spaced and concentric arc shaped portions extending between the inlet port and the outlet port for forming radially spaced arc shaped passageways for the recirculating fluid from the inlet port to the outlet port.

6. The viscous heater according to claim 5, wherein the passageway at a radially outer location has an increased width compared to the passageway located at a radially inner location.

7. The viscous heater according to claim 4, wherein a space exists between an end of the fins and an inner surface of the housing forming the heat emission chamber.

8. The viscous heater according to claim 1, wherein at least the surface of each of the side plates forming the heat emission chamber is formed as a molded surface.

9. The viscous heater according to claim 1, further comprising means arranged between the front and rear side plates and the front and rear housings for preventing the side plates from rotating.

10. The viscous heater according to claim 9, wherein said rotation preventing means comprises a first engaging part and a second engaging part in the surfaces of the side plate and the housing which face each other, said first and second engaging parts being engaged with each other in a direction of rotation.

11. The viscous heater according to claim 10, wherein said seal member is an O-ring.

12. The viscous heater according to claim 1, wherein the fitting part of the rear side plate forms an inwardly recessed portion which forms a sealed storage chamber for the viscous fluid in the heat generating chamber in cooperation with the rear housing.

13. The viscous heater according to claim 1, wherein the fitting part of said at least one side plate and the fitting part of said at least one housing include axially overlapping parts at their facing surfaces, and a seal member is arranged between the facing surfaces of the overlapping parts.

14. The viscous heater according to claim 13, wherein the axially overlapping part of the fitting part of the rear side plate forms an inwardly recessed portion which forms a sealed storage chamber for the viscous fluid in the heat generating chamber in cooperation with the rear housing.

15. The viscous heater according to claim 13, wherein said seal member is an O-ring.

16. The viscous heater according to claim 1, further comprising a shaft seal unit arranged between said bearing means and the heat generating chamber for obtaining a sealing of the drive shaft, the heat emission chamber extending to a location adjacent to the shaft seal unit.

17. The viscous heater according to claim 1, wherein said bearing means is arranged in said front side plate, said bearing means comprising a sealing means for sealing the drive shaft, said heat emission chamber extending to a location adjacent to the said bearing means.

* * * * *

UNITED STATES PATENT AND TRADEMARK OFFICE

CERTIFICATE OF CORRECTION

PATENT NO. : 5,881,711

DATED : April 22, 1999

INVENTOR(S) : Takashi BAN, Shigeru SUZUKI, Tatsuyuki HOSHINO, Hidefumi MORI, and Takahiro MOROI It is certified that error appears in the above-identified patent and that said Letters Patent is hereby corrected as shown below:

Title page, In Item 73, the Assignee should be listed as
KABUSHIKI KAISHA TOYODA JIDOSHOKKI SEISAKUSHO Signed and Sealed this Third Day of August, 1999

*Attest:*

Q. TODD DICKINSON

*Attesting Officer*

*Acting Commissioner of Patents and Trademarks*